United States Patent [19]

Strange-Boston et al.

[11] Patent Number: 4,471,574

[45] Date of Patent: Sep. 18, 1984

[54] SHUTTER OPERATING SYSTEM

[76] Inventors: Donald L. Strange-Boston; William C. Anderson, both of c/o Jones & Strange-Boston, 725 Ross Bldg., Richmond, Va. 23219

[21] Appl. No.: 359,389

[22] Filed: Mar. 18, 1982

[51] Int. Cl.[3] ..... E05F 11/04

[52] U.S. Cl. ..... 49/347; 52/69; 49/362

[58] Field of Search ..... 52/69, 64; 49/347, 276, 49/387, 362

[56] References Cited

U.S. PATENT DOCUMENTS 1,793,991 2/1931 Blocki ..... 52/64 X 1,966,934 7/1934 Scheineman et al. ..... 49/387

FOREIGN PATENT DOCUMENTS 1462376 11/1966 France ..... 49/276

OTHER PUBLICATIONS

William K. Langdon–Movable Insulation—1980, Chaps. 10, 14 & 15.

*Primary Examiner*—Kenneth Downey

*Attorney, Agent, or Firm*—Beveridge, DeGrandi & Kline

[57] ABSTRACT

A shutter operating system for a shutter hinged along a horizontal axis of an opening such as a fenestration in a wall includes cables attached to the free end of the shutter which are threaded through passages in the wall above the fenestration and to a horizontal counterweight member operating multiple cable pull points evenly through use of vertical equalizer brackets and restraint roller assemblies, assisted in operation by a hydraulic or pneumatic piston assembly, which opens and closes the shutter. The shutter operating system can also be operated manually without the assistance of the hydraulic or pneumatic piston assembly.

12 Claims, 8 Drawing Figures

FIG. 2
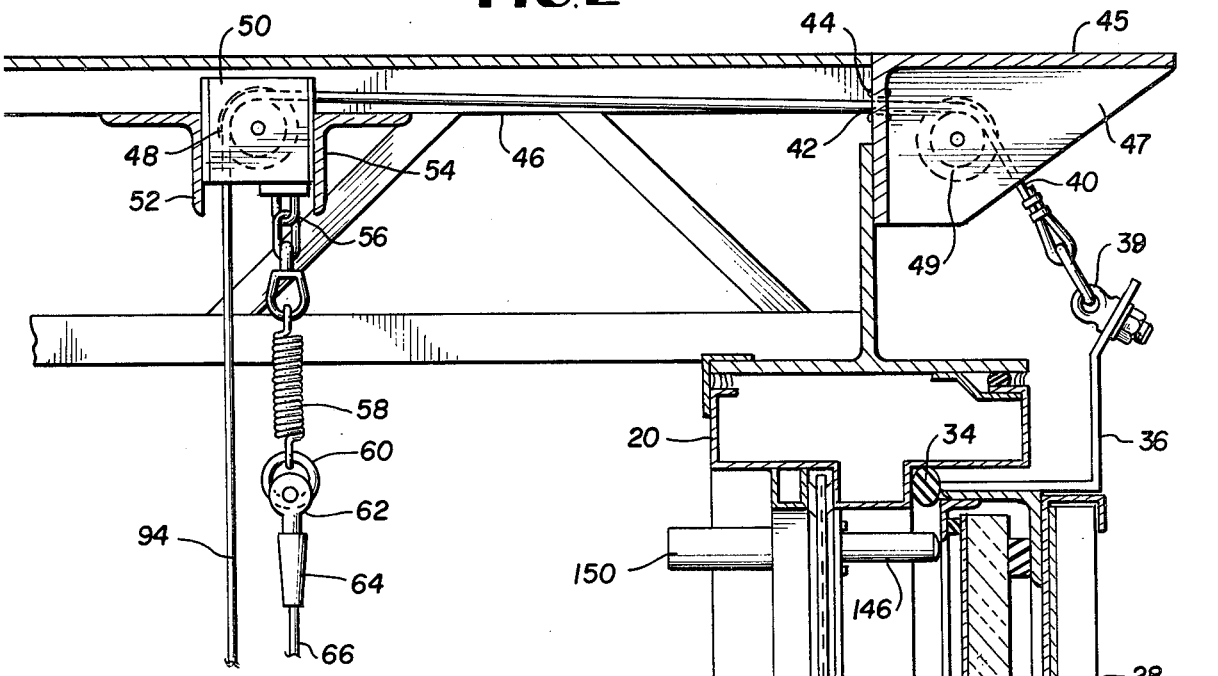
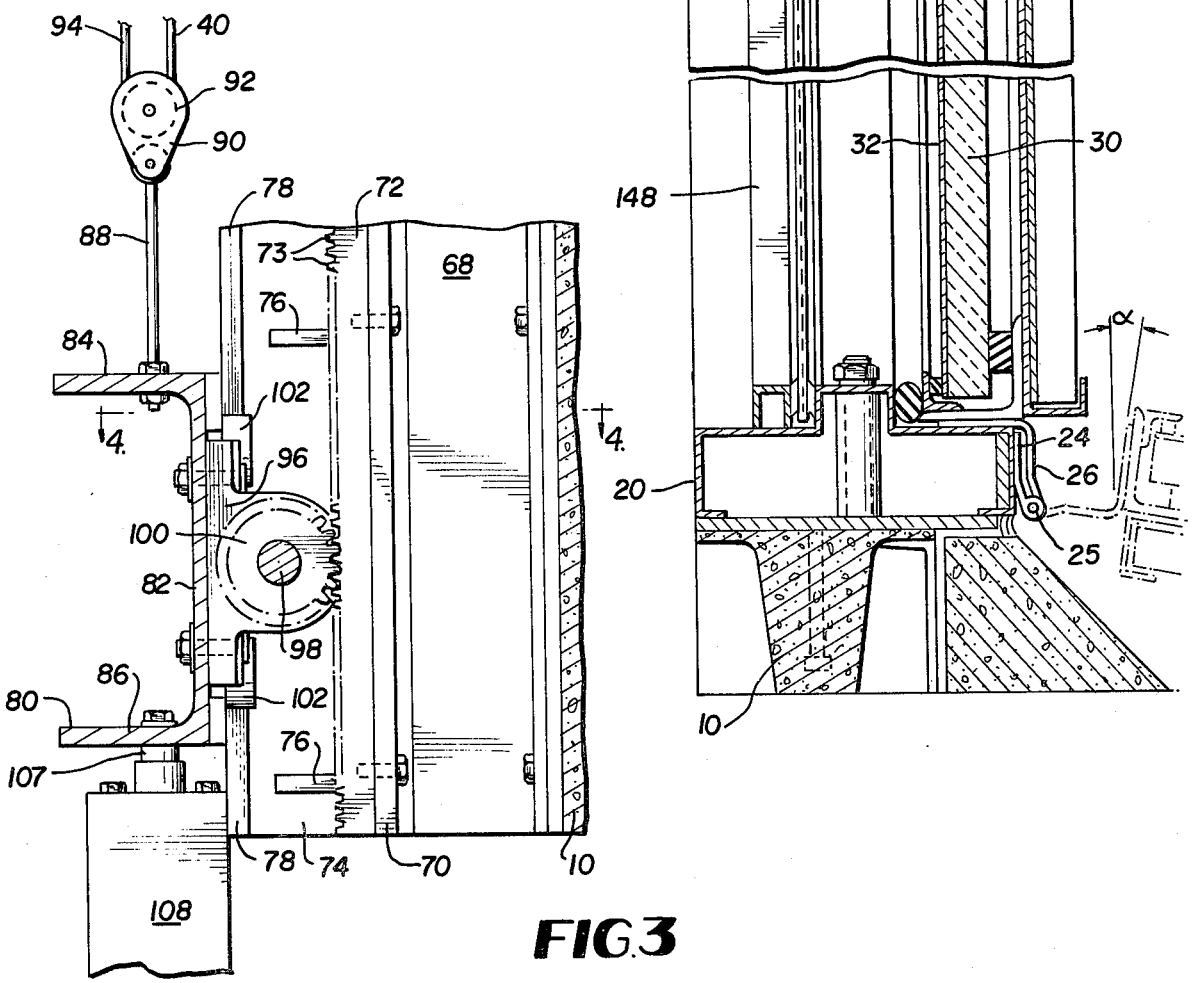
FIG. 3

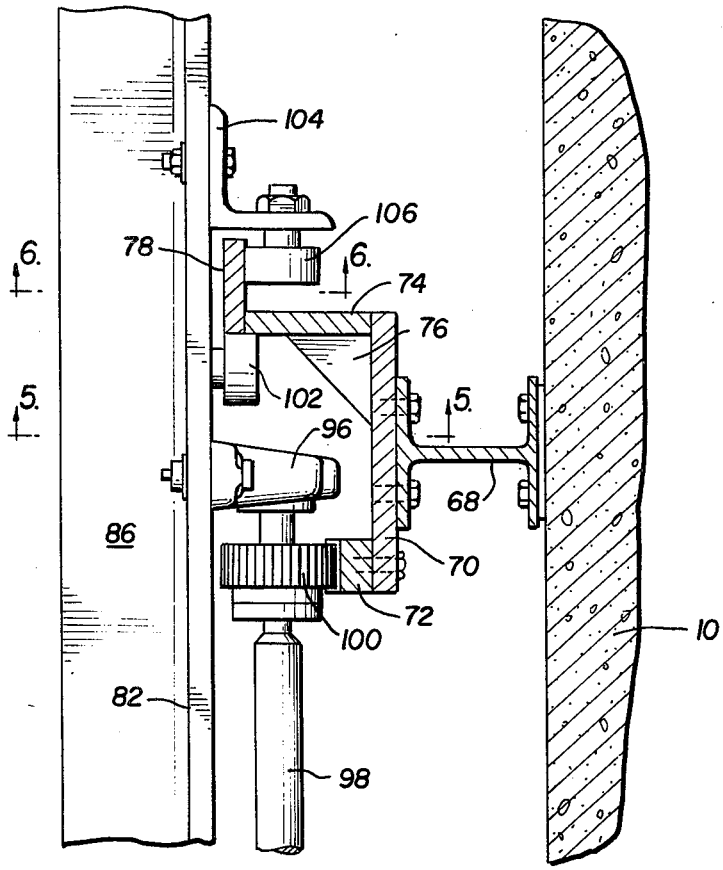
FIG. 4
FIG. 5
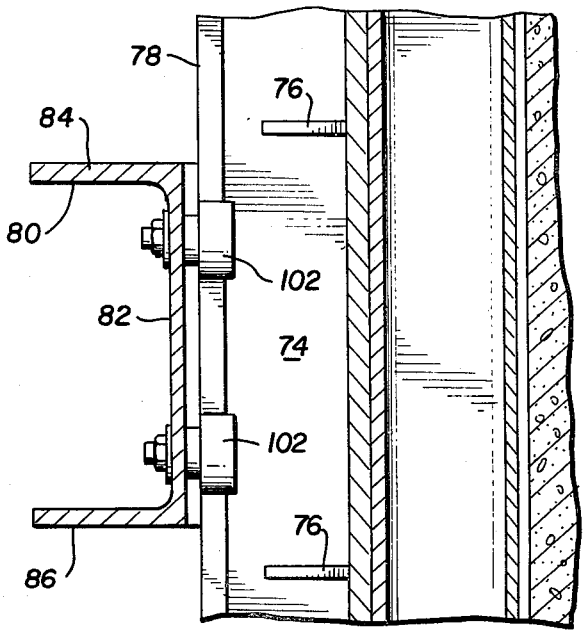
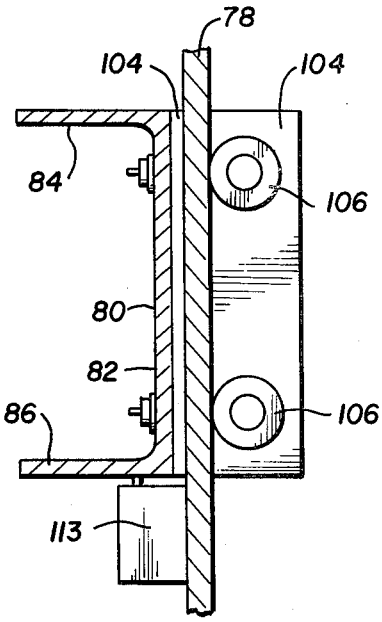
FIG. 6

FIG. 8
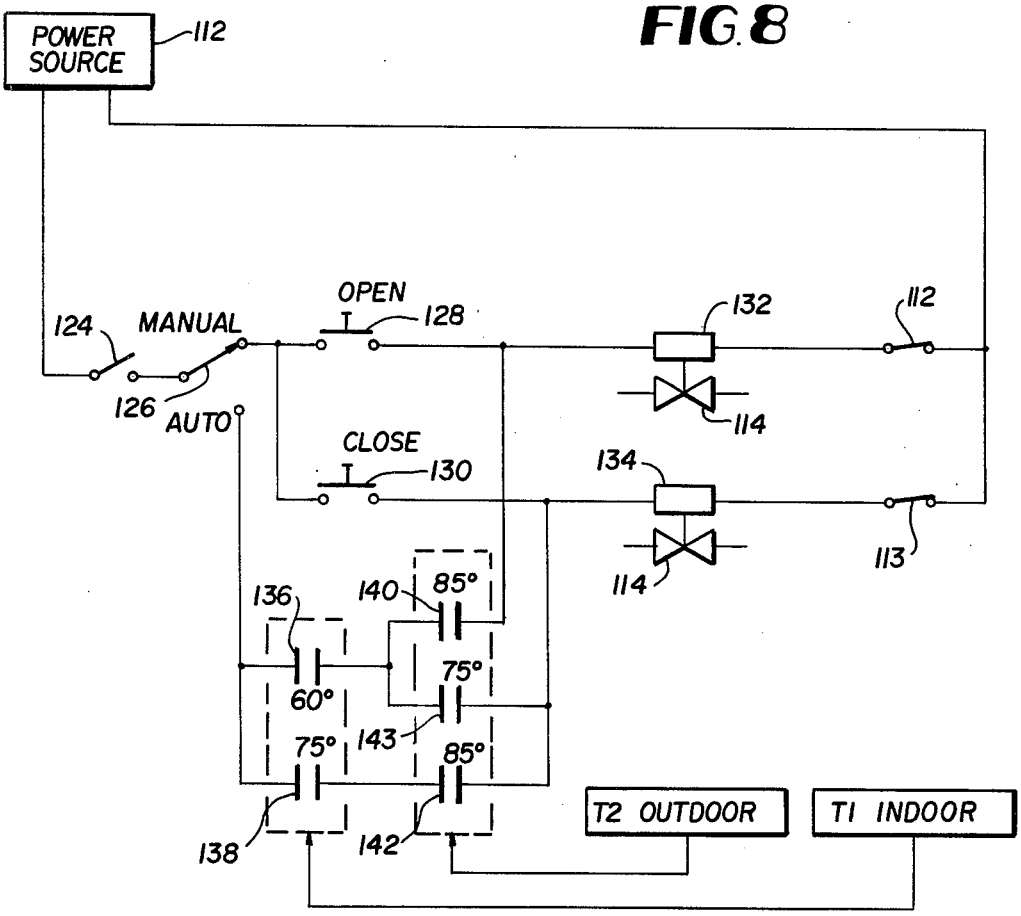
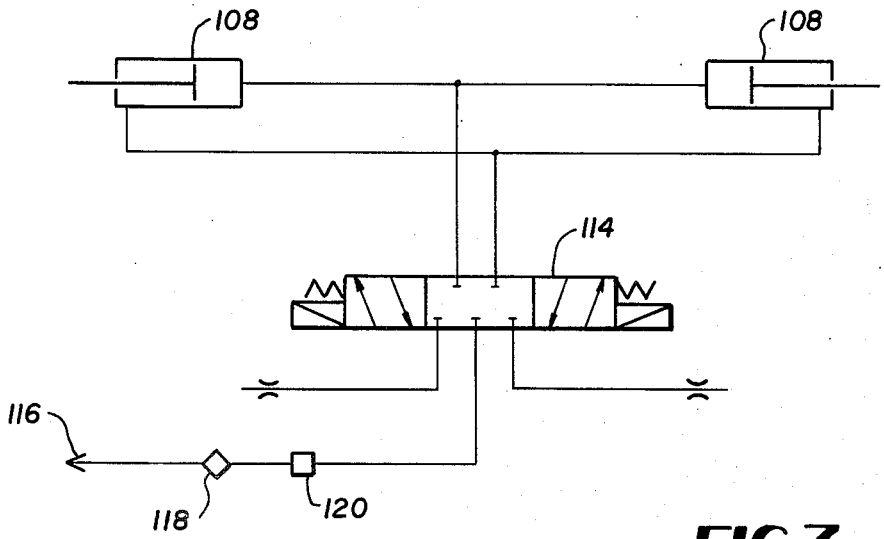
FIG. 7

SHUTTER OPERATING SYSTEM

BACKGROUND OF THE INVENTION

The present invention relates to an apparatus for opening and closing shutters of an opening such as a fenestration of a building.

The invention is particularly well-suited for use with a shutter which is hinged about a horizontal axis at the bottom of a fenestration. It is also suited for such shutters hinged about a horizontal axis at the top of a fenestration. The closure systems can open and close the shutter by causing it to pivot about the horizontal axis, under either manual or automatic control.

In buildings having a long horizontal fenestration or window, a long shutter covering such a fenestration and pivoted about a horizontal axis would be subject to forces acting perhaps unequally along the length of the shutter. These unequal forces have been viewed by the art as giving rise to destructive torsions and imbalances, hence this construction technique has not been available for implementation.

The present invention, on the other hand, provides a closure system which allows such a long shutter to be accurately controlled and balanced so that unequal forces do not arise to result in destructive effects.

SUMMARY OF THE INVENTION

This unique balance results from a closure system for a shutter hingedly mounted to one side of a wall along a horizontal edge of an opening in the wall including passages through the wall at an elevation higher than the hinged mounting, vertical brackets mounted on the side of the wall remote from the shutter, having means defining vertical levels, a horizontal member interconnected with the vertical brackets adapted to move vertically therealong and having means cooperating with the vertical level defining means of the vertical brackets to assure that the interconnections of the horizontal member with each of the brackets are at equal elevations, cables connected to the shutter at a location spaced from the hinged mounting, threaded through the passages, and connected to the horizontal member, whereby vertical movement in one direction of the horizontal member applies tension to the cables to elevate the spaced location of the shutter against the force of gravity and vertical movement in the other direction of the horizontal member releases tension on the cables to allow the spaced location of the shutter to descend under the force of gravity.

Preferably the closure system includes means for moving the horizontal member vertically along the vertical brackets.

The means defining vertical levels on the vertical brackets can be a rack of teeth, and the means cooperating with the vertical level defining means can include a shaft substantially parallel to the horizontal means and rotatably mounted thereon having pinions, each of which mesh with the teeth of one of the racks.

Preferably the closure system includes means mounted on the wall spaced from the hinged mounting for urging the shutter away from a vertical position to a position where the force of gravity acting on the shutter imparts a torque thereto.

The vertical brackets can include means defining lateral positions parallel and perpendicular to the wall and the horizontal member can include means cooperable with the means defining lateral positions to inhibit movement of the horizontal member laterally parallel or perpendicular to the wall.

Furthermore, the means defining lateral positions can include a vertical surface substantially parallel to the wall and a vertical surface substantially perpendicular to the wall and the cooperable means can include a first roller rotatable about a horizontal axis substantially parallel to the wall mounted on the horizontal member in a position in which the first roller bears against the vertical surface substantially parallel to the wall as the horizontal member moves vertically to inhibit movement of the horizontal member perpendicular to the wall, and a second roller rotatable about a horizontal axis substantially perpendicular to the wall mounted on the horizontal member in a position in which the second roller bears against the vertical surface substantially perpendicular to the wall as the horizontal member moves vertically to inhibit movement of the horizontal member laterally parallel to the wall.

If the opening is proximate the top of the wall, then preferably the vertical brackets and the horizontal member are spaced below the opening. More preferably, the vertical brackets and the horizontal member are mounted on the wall at an elevation allowing manual movement of the horizontal member without a ladder.

The system can include a first control means adapted to terminate upward vertical movement of the horizontal member and a second control means to terminate downward movement of the horizontal member. The system can also include sensors for sensing indoor and outdoor conditions and means responsive to sensed conditions to actuate the means for moving the horizontal member vertically along the brackets. The system can further include means manually operable to actuate the means for moving the horizontal member vertically along the brackets.

BRIEF DESCRIPTION OF THE DRAWING

The invention will be better understood from a reading of the detailed description hereinafter, along with a study of the drawings in which:

FIG. 2 is an enlarged vertical sectional view along lines 2—2 of FIG. 1;

FIG. 3 is an enlarged vertical sectional view taken along lines 3—3 of FIG. 1;

FIG. 4 is a sectional view taken along lines 4—4 of FIG. 3;

FIG. 5 is a vertical sectional view taken along lines 5—5 in FIG. 4;

FIG. 6 is a vertical sectional view taken along lines 6—6 in FIG. 4;

FIG. 7 is a schematic diagram of a suitable pneumatic system useful in the invention;

FIG. 8 a suitable schematic electrical control circuit useful in the invention.

DETAILED DESCRIPTION OF A PREFERRED EMBODIMENT OF THE INVENTION

Figure 1:
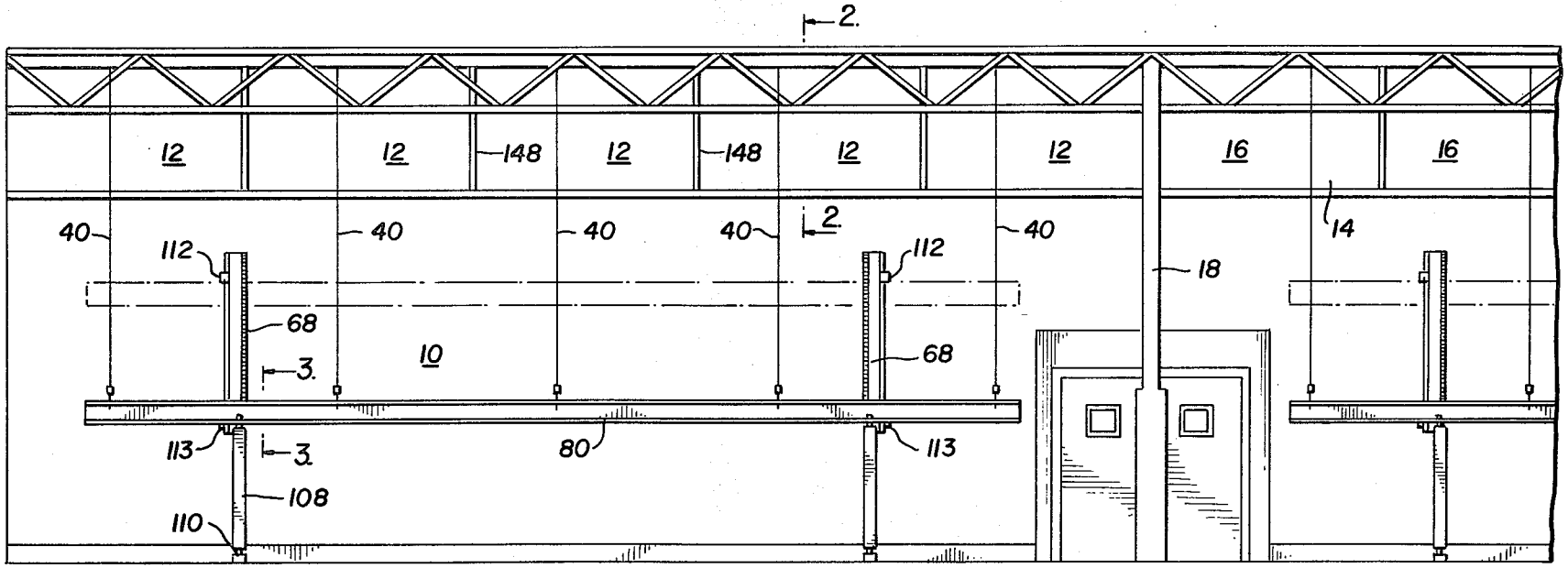
FIG. 1 is an elevational view of a wall having a lengthy horizontal fenestration and equipped with the apparatus of the present invention.

Referring to FIG. 1, a wall 10 of a building is shown provided with a series of window panes 12 horizontally thereacross, separated by frame members 148, forming a fenestration 14. A second series of panes 16 forms an additional fenestration 14. The two fenestrations are divided by a column 18, but each in itself represents a long fenestration. In the embodiment of FIG. 1, the fenestrations are located in the upper portion of wall 10, however, other placements on vertical or sloping walls can easily be accommodated, as can differing vertical and horizontal sizes and proportions, as will be apparent to those of ordinary skill in the art.

Referring to FIG. 2, the window pane 12 can be seen in greater detail, with the pane and frame member 148 mounted in a frame 20 in conventional fashion. Frame 20 has shutter 22 hinged thereto by hinge plate 24, hinge strap 26 and hinge pin 25. The hinge allows shutter 22 to pivot about the horizontal axis of the hinge from a fully closed position shown in solid lines to a fully open position, shown in phantom in FIG. 2.

A preferred shutter is a laminate of an outer corrugated sheet metal siding 28, an inner core of rigid insulation 30 and a specularly finished aluminum sheet 32. The specular finish on the aluminum sheet aids in the reflection of light to the interior of the building. Other shutter constructions can be used.

When the shutter is in the full open position, it forms an angle $\alpha$ with the horizontal. This angle $\alpha$ can be selected to maximize the reflection of sunlight off the shutter into the window for a south-facing wall. As will be apparent, for southern hemisphere buildings, the same could be accomplished for a north-facing wall. The angle $\alpha$ is selected according to the latitude of the geographical setting for the building in which the invention is being incorporated. In the region of Richmond, Va., the optimum angle $\alpha$ is in the region of 5°.

An elastomer gasket 34 is provided around the opening of frame 20 which receives shutter 22. Steel strap 36 attached to the top of the shutter 22 has an eye 38 to which is attached cable 40. Cable 40 is threaded through passage 42 in the upper portion of wall 10. Passage 42 is provided with a rounded interior vinyl grommet 44 not only to reduce the frictional wear arising from the movement of cable 40, but also minimizes the size of passage 42 to provide insulation to reduce convective and conductive heat transfer between the interior and exterior of the building.

As can be seen from FIG. 2, wall 10 includes angle 45 having gusset 47 on which pulley 49 is rotatably mounted.

Tension spring rod 146 is mounted in upright window frame members 148, spaced as required. Tension spring rod 146 is movable between an inner position (shown in FIG. 2) and an outer position, with a spring in casing 150 urging rod 146 to its outward position, to the right in FIG. 2. This urging is opposed and overcome by the tension on cable 40 when shutter 22 is closed. However, when the tension on cable 40 is released, the force on rod 146 is of a sufficient magnitude to tilt the top of shutter 22 to the right (in FIG. 2) to cause it to be non-vertical, thereby allowing the force of gravity acting on the shutter to result in a clockwise torque about hinge 25, to tend to open the shutter.

Wall 10 supports joist 46 which in turn supports pulley 48 journalled in bracket 50 by way of angles 52 and 54. Angle 54 and bracket 50 also have eye 56 rigidly mounted thereon. Depending from eye 56 are tension spring 58 and ring 60. Eye bolt 62, interconnected with ring 60, is connected to open socket 64 to which terminal end 66 of cable 40 is attached.

Referring back to the embodiment shown in FIG. 1, there are five such cable arrangements, each substantially as described heretofore, spaced along the length of wall 10 and attached at appropriate locations to shutter 22.

Rigidly mounted on wall 10 are a pair of equalizer brackets 68. As can be seen in FIG. 1, the two equalizer brackets 68 are substantially mirror images of one another, although this is not required. Equalizer bracket 68 is conveniently provided as a steel member securely fastened to wall 10, as seen in FIG. 4, reinforced and widened along one flange thereof by a cold-rolled steel plate 70. Plate 70 has arranged vertically along one edge thereof a steel rack 72 having a plurality of vertically spaced teeth 73. Teeth 73 define vertical levels along the equalizer bracket. On its other side, plate 70 has vertical cold-rolled steel strip 74 rigidly attached thereto and reinforced by gussets 76. Vertical strip 74 defines a vertical surface substantially perpendicular to wall 10. Another cold-rolled steel vertical plate 78 is provided on strip 74, parallel with wall 10. These elements 70, 72, 74 and 78 defining a vertical surface run along substantially the entire vertical extent of equalizer bracket 68.

There are at least two equalizer brackets 68 required for each installation according to the present invention, as seen in FIG. 1. Optionally, there can be more than two. The placement of the brackets on wall 10 is preferably carefully selected so that their vertical indicating levels, as by the teeth 73 of one rack 72 are at substantially the same height as the teeth 73 of each other rack 72.

The equalizer brackets 68 are interconnected by a horizontal member such as aluminum channel 80 which constitutes a counterweight balancing a preselected portion of the torque generated by the weight of the shutter. As can be seen in FIG. 3, channel 80 includes a vertical segment 82, an upper horizontal segment 84 and a lower horizontal segment 86. Upper horizontal segment 84 is rigidly engaged to eye bolt 88, to which is attached snatch block 90, including a pulley 92.

Referring back to FIG. 2, cable length 94 depending from pulley 48 passes around pulley 92 and returns up as terminal end 66 in open socket 64. As will be apparent, for each cable 40 indicated in FIG. 1, there is an eye bolt 88 at the appropriate location in the upper segment 84 of channel 80. Other suitable cable and pulley arrangements may also be employed.

Vertical segment 82 of channel 80 is provided with a self-aligning pillow block bearing 96 in which is journalled steel shaft 98. In the embodiment depicted in FIG. 1, four such pillow block bearings 96 are provided, one adjacent each equalizer bracket and two spaced intermediate the brackets. Journalled in the end pillow block bearings is a single shaft 98. Rigidly connected to shaft 98 at each equalizer bracket is a pinion 100 whose teeth mesh with the teeth 73 of rack 72. Thus, vertical movement of one pinion in contact with its mating rack results in rotation of shaft 98 and the other pinion 100 and vertical movement of the other pinion along its rack 72.

Referring now to FIG. 5, it will be apparent that channel 80 also has a pair of cam rollers 102 rotatably mounted about an axis perpendicular to wall 10 on its vertical segment 82. The positioning of rollers 102 longitudinally along channel 80 is selected so that they will engage the surface of vertical strip 74 perpendicular to wall 10 when pinions 100 engage their respective equalizer racks. Having the equalizer brackets as mirror images of one another allows this construction to prevent movement of channel 80 laterally parallel to wall 10.

One set of rollers 102 cooperates with the left equalizer bracket 68 to prevent movement to the left in FIG. 1 and the other set cooperates with the right bracket to prevent movement of channel 80 to the right.

As can be seen from FIGS. 4 and 6, vertical segment 82 is also provided with angle bracket 104 which has rotatably mounted thereon another pair of cam rollers 106 about horizontal axes substantially parallel with wall 10. The placement of rollers 106 is selected so that they will bear against the wall-facing side of plate 78.

Referring back to FIG. 1, it can be seen that air cylinders 108 are mounted to the lower portion of the building by clevis mounts 110. Hydraulic, rather than pneumatic, cylinders could be substituted. Lower horizontal segment 86 receives the piston rod 107 of air cylinder 108. As will be apparent, the extension of piston rods 107 elevates channel 80 and the retraction of piston rods 107 lowers channel 80.

As can be seen in FIG. 1 in phantom, channel 80 can be elevated to a topmost position adjacent a limit switch 112, which is tripped open when channel 80 is in its topmost position. Its lowermost position is indicated in full lines, and limit switch 113 mounted on bracket 68 is tripped open by channel 80 when fully lowered.

The pneumatic system can be seen with reference to FIG. 7. Each of the cylinders 108 for channel 80 are fitted to a common air pressure supply system in parallel so as to provide uniform operation of all of the cylinders for a given channel 80. The cylinders 108 are connected by way of pneumatic supply lines to a four-way, three-position double solenoid air valve 114. As shown in FIG. 7, valve 114 has a neutral center position, a left position in which pressure is applied to cylinders 108 so as to cause them to extend their piston rods, and a right position which causes cylinders 108 to retract their piston rods. The supply through valve 114 is applied from an air supply line 116 through filter 118 and pressure regulator 120.

Referring to FIG. 8, the electrical controls for the pneumatic supply system can be seen. Power is taken from an electrical line source 122 and applied via master on/off switch 124 to mode selector switch 126. Mode selector switch 126 provides either "manual" or "auto" operation of the control. The "manual" circuit branches to a shutter opening circuit and a shutter closing circuit. These are normally open circuits, but can be closed to perform their designated function upon the depression of push buttons 128 or 130, respectively. The closing of switch 128 applies the line current to solenoid 132, shifting air valve 114 to the left and causing cylinders 108 to extend their piston rods. Valve 114 stays in this left position applying air pressure to cylinders 108 until the solenoid 132 is de-energized by the opening of the circuit caused by the tripping of limit switch 112 by channel 80 at the top of its travel.

Similarly, the closing of push button 130 energizes solenoid 134 shifting air valve 114 to the right and causing cylinders 108 to retract until channel 80 trips limit switch 113 to de-energize solenoid 134.

When mode selector switch 136 is in the "auto" position, push buttons 128 and 130 are deactivated and the shutter is controlled by a thermostatic system. An outdoor-sensing thermostat T2 and an indoor-sensing thermostat T1 are coupled through the "auto" circuit to solenoids 132 and 134.

Thermostat T1 closes a contact 136 when the indoor temperature is below 60° F., and closes contact 138 when the indoor temperature exceeds 75° F.

The T2 outdoor thermostat closes contacts 140 and 142 when the outdoor temperature exceeds 85° F., and closes contact 143 when the outdoor temperature is below 75° F.

Thus, when the indoor temperature is below 60° F. and the outdoor temperature is above 85° F., contacts 136 and 140 are closed, energizing solenoids 132 to provide an opening signal for the shutter mechanism.

When the indoor temperature exceeds 75° F. and the outdoor temperature exceeds 85° F., the two contacts 138 and 142 close to provide a shutter closing signal to solenoid 134. Also, when the indoor temperature is below 60° F. and the outdoor temperature is below 75° F., the two contacts 136 and 143 close to provide a shutter closing signal to solenoid 134.

As will be apparent, other thermostat settings and indoor/outdoor differentials can be selected as desired. For example, one or more of the sensing units could be responsive to light levels. Other parameters can be used as control inputs as well.

Preferably, the apparatus is placed on wall 10 at such a location and with cables 40 of sufficient length that channel 80 can be raised and lowered by hand without a ladder so that the shutter can be opened and closed even in the event of a power failure. Additionally, it facilitates such manual (as well as automatic) operation if the weight of channel 80 is selected to counterbalance the weight of the shutter 22.

The operation of the device is relatively straightforward. Assuming the shutter to be closed, it will be in the position shown in full lines in FIG. 2 and channel 80 will be in the position shown in full lines in FIG. 1. The opening of shutter 22 will be accomplished either manually or automatically, depending upon the position of mode selector switch 126. In the manual mode, the shutter is opened by depressing push button 128, thereby energizing solenoid 132 to apply air pressure to cylinders 108 to cause them to extend their piston rods. In the automatic mode, the shutter will open when the indoor temperature is below 60° F. and the outdoor temperature exceeds 85° F so that the solenoid 132 is energized.

The extension of the piston rod 107 of cylinders 108 exerts a force on channel 80 to elevate it vertically along equalizer brackets 68. The forces applied through each of cylinders 108 are substantially equal, but even if one of cylinders 108 should fail, the equalizer brackets 108 assure that channel 80 remains horizontal as it moves vertically. This is accomplished by the interconnection of the two equalizer brackets 68 through shaft 98, pinion 100 and equalizer racks 72. Thus, one end of channel 80 cannot be elevated without elevating the other end because of the positive linkage of the vertical levels defined by teeth 73 of the two equalizer brackets. Furthermore, the channel 80 is prevented from moving laterally by cam rollers 102 and 106.

The upward movement of channel 80 releases tension along cables 40, allowing the tension spring rod 146 to urge the top of shutter 22 away from gasket 34, thereby allowing the force of gravity acting on shutter 22 to create a torque to cause the shutter to pivot clockwise in the view of FIG. 2 about hinge pin 25. As channel 80 is elevated, cable 40 is played out over pulley 48, out through passage 42, and over pulley 49, to shutter 22, thereby lowering the shutter. This lowering continues until the channel 80 trips limit switch 112, thereby opening the circuit to solenoid 132 and shifting air valve 114 back to its neutral position. At the time that limit switch 112 is tripped, the shutter forms the angle $\alpha$ with the horizontal.

The closing of the shutter is accomplished in the manual mode by closing push button 130. In the automatic mode, closing is accomplished by the rise of the outdoor temperature above 85° F. with the indoor temperature in excess of 75° F. or by the fall of the outdoor temperature below 75° F. with the indoor temperature below 60° F. This shifts air valve 114 to cause cylinders 108 to retract their piston rods to pull channel 80 downwardly. Again, the vertical movement of channel 80 is accomplished while maintaining it horizontal. The movement applies tension to cable 40 to rotate shutter 22 upward to its closed position. When limit switch 113 is opened by the channel 80, it opens the circuit to solenoid 134 allowing air valve 114 to return to its neutral center position. Thus, the downward movement of channel 80 is halted when shutter 22 is closed.

It will be apparent that by maintaining the channel 80 horizontal at all times, the tensions on cables 40 remain constant and the entire shutter pivots uniformly along its length without localized irregularities giving rise to destructive torsions. Furthermore, the use of tension spring 58 assures that the movements of the shutter are cushioned.

Although the invention has been described with reference to one specific embodiment, other embodiments will be apparent to those of ordinary skill without departing from the scope of the invention.

What is claimed is:

1. A closure system for a shutter hingedly mounted to one side of a wall along a horizontal edge of an opening in the wall comprising at least a pair of passage means through said wall at an elevation higher than the hinged mounting, a pair of vertical brackets mounted on the side of the wall remote from the shutter, each having means defining vertical levels, a horizontal member interconnected with each of said vertical brackets, adapted to move vertically therealong, and having means cooperating with said vertical level defining means of said vertical brackets to assure that said interconnections of said horizontal member with each of said brackets are at equal elevations, at least a pair of cable means each connected to said shutter at a location spaced from said hinged mounting, threaded through said passage means, and connected to said horizontal member, whereby vertical movement of said horizontal member in one direction applies tension to said cable means to elevate said spaced location of said shutter against the force of gravity and vertical movement of said horizontal member in the other direction releases tension on said cable means to allow said spaced location of said shutter to descend under the force of gravity.

2. A closure system as claimed in claim 1 further comprising means for moving said horizontal member vertically along said vertical brackets.

3. A closure system as claimed in claim 1 wherein said means defining vertical levels on said vertical brackets comprise a rack of teeth, and said means cooperating with said vertical level defining means comprises a shaft substantially parallel to said horizontal means and rotatably mounted thereon having pinions meshing with the teeth of said racks.

4. A closure system as claimed in claim 1 further comprising means mounted on said wall spaced from said hinged mounting for urging said shutter away from a vertical position to a position where the force of gravity acting on said shutter imparts a torque thereto.

5. A closure system as claimed in claim 1 in which said vertical brackets include means defining lateral positions parallel and perpendicular to said wall and said horizontal member includes means cooperable with said means defining lateral positions to inhibit movement of said horizontal member laterally parallel or perpendicular to said wall.

6. A system as claimed in claim 1 in which said opening is proximate the top of said wall and said vertical brackets and said horizontal member are spaced remote from said opening.

7. A system as claimed in claim 6 in which said vertical brackets and said horizontal member are mounted on said wall at an elevation allowing manual movement of said horizontal member without a ladder.

8. A system as claimed in claim 2 comprising a first control means adapted to terminate upward vertical movements of said horizontal member and a second control means to terminate downward movement of said horizontal member.

9. A system as claimed in either of claims 2 or 8 comprising sensors for sensing indoor and outdoor conditions and means responsive to sensed conditions to actuate said means for moving said horizontal member vertically along said brackets.

10. A system as claimed in claim 10 further comprising means manually operable to actuate said means for moving said horizontal member vertically along said brackets.

11. An apparatus as claimed in claim 1 further comprising a fluid pressure ram for moving said horizontal member vertically along said vertical brackets.

12. A closure system for a shutter hingedly mounted to one side of a wall along a horizontal edge of an opening in the wall comprising a pair of passage means through said wall at an elevation higher than the hinged mounting, a pair of vertical brackets mounted on the side of the wall remote from the shutter, each having means defining vertical levels, a horizontal member interconnected with each of said vertical brackets, adapted to move vertically therealong, and having means cooperating with said vertical level defining means of said vertical brackets to assure that said interconnections of said horizontal member with each of said brackets are at equal elevations, a pair of cable means, each connected to said shutter at a location spaced from said hinged mounting, threaded through said passage means, and connected to said horizontal member, whereby vertical movement of said horizontal member in one direction applies tension to said cable means to elevate said spaced location of said shutter against the force of gravity and vertical movement of said horizontal member in the other direction releases tension on said cable means to allow said spaced location of said shutter to descend under the force of gravity, wherein said vertical brackets includes means defining lateral positions parallel and perpendicular to said wall and said horizontal member includes means cooperable with said means defining lateral positions to inhibit movement of said horizontal member laterally parallel or perpendicular to said wall, wherein said means defining lateral positions include a vertical surface substantially parallel to said wall and a vertical surface substantially perpendicular to said wall, and wherein said cooperable means includes a first roller rotatable about a horizontal axis substantially parallel to said wall mounted on said horizontal member in a position in which said first roller bears rollingly against said vertical surface substantially parallel to said wall as said horizontal member moves vertically, to inhibit movement of said horizontal member perpendicular to said wall and a second roller rotatable about a horizontal axis substantially perpendicular to said wall mounted on said horizontal member in a position in which said second roller bears rollingly against said vertical surface substantially perpendicular to said wall as said horizontal member moves vertically, to inhibit movement of said horizontal member laterally parallel to said wall.

* * * * *